US011920205B2

(12) United States Patent
Itamura et al.

(10) Patent No.: US 11,920,205 B2
(45) Date of Patent: Mar. 5, 2024

(54) SPHERICAL GRAPHITE CAST IRON SEMI-SOLID CASTING METHOD AND SEMI-SOLID CAST PRODUCT

(71) Applicants: TOHOKU UNIVERSITY, Miyagi (JP); KABUSHIKI-KAISHA FACT, Miyagi (JP)

(72) Inventors: Masayuki Itamura, Miyagi (JP); Haruki Itofuji, Miyagi (JP); Mitsuru Adachi, Miyagi (JP)

( * ) Notice: Subject to any disclaimer, the term of this patent is extended or adjusted under 35 U.S.C. 154(b) by 0 days.

(21) Appl. No.: 17/664,429

(22) Filed: May 23, 2022

(65) Prior Publication Data

US 2022/0275467 A1 Sep. 1, 2022

Related U.S. Application Data

(62) Division of application No. 16/330,104, filed as application No. PCT/JP2017/031470 on Aug. 31, 2017, now abandoned.

(30) Foreign Application Priority Data

Sep. 4, 2016 (JP) ..... 2016-172355

(51) Int. Cl.
*C21C 1/10* (2006.01)
*B22D 1/00* (2006.01)
(Continued)

(52) U.S. Cl.
CPC ..... *C21C 1/10* (2013.01); *B22D 1/00* (2013.01); *B22D 27/04* (2013.01); *B22D 27/20* (2013.01); *C22C 33/10* (2013.01); *C22C 37/04* (2013.01)

(58) Field of Classification Search
CPC .. C21C 1/10; B22D 1/00; B22D 27/04; B22D 27/20; C22C 33/10; C22C 37/04
(Continued)

(56) References Cited

U.S. PATENT DOCUMENTS

2004/0250927 A1* 12/2004 Ohtake ..... B22C 9/061 148/541

FOREIGN PATENT DOCUMENTS

JP 56-35993 B2 8/1981
JP 8-90191 A 4/1996
(Continued)

OTHER PUBLICATIONS

Haruki Itofuji et al. Non-Chill Mold Casting of Spheroidal Graphite Iron, Japanese Foundry Engineering Society, Reports of the 166th JFS Meeting, May 1, 2015 (Year: 2015).*
(Continued)

*Primary Examiner* — Brian D Walck
*Assistant Examiner* — Danielle M. Carda
(74) *Attorney, Agent, or Firm* — PATSHEGEN IP; Moshe Pinchas

(57) ABSTRACT

The present invention provides a casting method and cast product of spherical graphite cast iron, in which, even with a small modulus, there is no chill, the spherical graphite in the tissue is further made ultrafine, the dispersion of the particle diameter is small, and the number of the particles is several times that of the conventional one in the as cast state where heat treatment is not carried out. A casting method of a spherical graphite cast iron includes a melting process, a spheroidizing treatment process, an inoculation process, and a casting process, in which the original molten metal after the inoculation process is poured and filled up to a product space through a gate of a metal mold; where the original molten metal is controlled to a semi-solidification temperature range, before being filled up to the product space.

5 Claims, 15 Drawing Sheets

(51) Int. Cl.

| | |
|---|---|
| ***B22D 27/04*** | (2006.01) |
| ***B22D 27/20*** | (2006.01) |
| ***C22C 33/10*** | (2006.01) |
| ***C22C 37/04*** | (2006.01) |

(58) Field of Classification Search
USPC ..... 75/560
See application file for complete search history.

(56) References Cited

FOREIGN PATENT DOCUMENTS

| | | | | |
|---|---|---|---|---|
| JP | 9-239514 | A | | 9/1997 |
| JP | 2004-223608 | A | | 8/2004 |
| JP | 2006-63396 | A | | 3/2006 |
| JP | 2012157886 | A | * | 8/2012 |
| WO | 2010/103641 | A1 | | 9/2010 |
| WO | 2013/039247 | A1 | | 3/2013 |

OTHER PUBLICATIONS

JP-2012157886-A Translation (Year: 2012).*
ISR: Japanese Patent Office; Oct. 31, 2017.
Haruki Itofuji et al.; "Kyujo Kokuen Chutetsu No Mu-Chill Kanagata Chuzo," May 1, 2015.

* cited by examiner (a)

t5.4 Metal Mold (Number of Graphite Particles 3222/mm2)

(b)

t6.5 Sand Mold (Number of Graphite Particles 1005/mm2)

(Standard) Number of Graphite Particles 150/mm$^2$

Number of Graphite Particles 3222/mm$^2$

50μm (1) Part A (2) Part B (3) Part C

SPHERICAL GRAPHITE CAST IRON SEMI-SOLID CASTING METHOD AND SEMI-SOLID CAST PRODUCT

TECHNICAL FIELD

The present invention relates to a semi-solid casting method of a spherical graphite cast iron and a semi-solid cast product. More specifically, the present invention relates to a semi-solid casting method of a spherical graphite cast iron having no chill and a number of ultrafine spherical graphite more than the conventional case in the as cast state without heat treatment, and being expected improved tensile strength/elongation and other properties, and a semi-solid cast product.

BACKGROUND ART

In recent years, the development of lightweight and strong ductile cast iron for automotive parts is being promoted from the viewpoint of CO2 emission reduction and fuel consumption improvement. Furthermore, because there is a big problem of reducing production cost, efforts have been made to produce ductile cast iron, which have been produced by sand mold casting, with die casting having high productivity. But it has not been widely spread due to problems of chill control and metal mold life.

In the field of semi-solidification/semi-melting of ductile cast iron, Patent Document 5 has been provided until now.

This document aims to provide a low temperature casting method and a low temperature casting apparatus of spherical graphite cast iron, which has high strength comparable to forging and does not cause external and internal defects, by precision casting using a metal mold. For this purpose, a vacuum processing step of holding the molten metal of the spheroidized spherical graphite cast iron in a vacuum processing apparatus and keeping it at a predetermined degree of vacuum for a predetermined time, a pouring step instantaneously injecting molten metal in a temperature range of 1350° C. to liquid phase temperature through a vacuum treatment step into a metal mold, and a pressurizing step of pressurizing the entire cavity of the metal mold with a pressurizing device after the injection of the molten metal are provided. Since the molten metal of spherical graphite cast iron is reformed by vacuum treatment, by casting molten metal in a low temperature region including a semi-solidifying temperature region is pressurized and rapidly cooled in the metal mold, castings of high strength spherical graphite cast iron with a fine tissue can be obtained.

In this technique, the vacuum of the cavity is utilized to ensure the fluidity of the molten metal. That is, even if the temperature of the molten metal is lowered, fluidity is maintained due to vacuum, but molten metal is filled in the cavity (Paragraph [0034] and FIG. 4 of the Patent Document 5). It is merely done in a semi-solidified state at the time of pressurization after filling with molten metal.

Further, based on FIG. 9 of the Patent Document 5, when examining the number of graphite particles obtained in this technique, the number of graphite particles is only 788 particles/mm$^2$.

On the other hand, mass production is already in the field of semi-solidified die casting of aluminum alloy. Under these circumstances, the semi-molten and semi-solid casting method is considered to be a molding method that can be expected as a low-cost molding method. Because, this method has excellent quality characteristics such as less generation of shrinkage cavity and segregation, fine metal tissue, and small amount of oxide contamination etc. Further, in this method, molding in a semi-solidified state enables molding in a high cycle.

The inventors of the present invention separately discovered that when free nitrogen was controlled in a metal mold casting, it was discovered that no chill was generated, and developed a technique of ultrafine graphitization with a non-heat treated casting material (Non-Patent Document 4).

In order to increase the strength and toughness of spherical graphite cast iron, efforts by a metal mold casting instead of a sand mold casting have been conducted, but at present it is not realized. This is due to the problem that the molten metal is quenched when producing spherical graphite cast iron in a metal mold and becomes a white pig ironized (chilled) tissue and the toughness decreases.

As shown in FIG. 4, when the cooling rate is increased, the number of graphite particles increases. But there is a limit because chill is formed. Horie et al. (Non-Patent Document 5) defines the number of graphite particles when the chill does not crystallize at a constant cooling rate as the number of chilled critical graphite particles, $N=0.58R^2+19.07R+1.01$ was calculated from the number of chilled critical graphite particles (N) and the cooling rate (R), and the number of critical graphite particles was found to be 960 particles/mm$^2$.

The present inventors found that chill is not generated if free nitrogen is controlled, developed a technique for ultrafine graphite, disclosed in the Non-Patent Document 4, and separately disclosed as a patent application.

FIG. 5 shows a metal tissue photograph of a conventional spherical graphite cast iron, and FIG. 6 shows a metal tissue photograph of a ultrafine spherical graphite cast iron. The ultrafine spherical graphite cast iron has 3222 particles/mm$^2$, which is 20 times more graphite particle count than conventional spherical graphite cast iron.

The spherical graphite cast iron is a kind of pig iron casting (Another name: cast iron), also called ductile cast iron. In the case of a gray cast iron, which is a kind of cast iron, graphite has a thin strip shape having a strong elongated anisotropy. In contrast, in the case of the spherical graphite cast iron, graphite has a spherical shape. The spherical graphite is obtained by adding a graphite spheroidizing agent containing magnesium, calcium and the like to the molten metal just before casting.

Because graphite without strength is spherical and independent in the spherical graphite cast iron, this casting is tenacious and tough as much as steel. Ductile means toughness, and spherical graphite is responsible for properties with material strength and elongation. Currently, it is widely used as a material for industrial equipment including the automobile industry.

As the graphite is fine and its particle number increases, the effect of inhibiting crack propagation at the time of impact is enhanced and the impact energy increases. Efforts have been made to refine and uniformly disperse the spherical graphite for the purpose of further improving the material.

A general metallographic tissue of a conventional spherical graphite cast iron is shown in FIG. 3. As shown in FIG. 3, the conventional spheroidized graphite cast iron generally has spherical graphite of 400 particles/mm$^2$ or less.

Attempts have also been made on spherical graphite cast iron as described in the following Patent Documents and Non-Patent Documents.

In the Patent Document 1 (JP H01-309939 A), the number of graphite particles becomes 300 particles/mm$^2$ or more by adding an appropriate amount of bismuth. In this technique, higher tensile strength and yield strength are achieved by adding an appropriate amount of nickel.

In the Patent Document 2 (JP H06-093369 A), by adding Ca to the molten metal in the presence of magnesium (Mg) and then adding Bi, fine spherical graphite finer than that in the conventional spherical graphite cast iron and Ca compound as free-cutting element are uniformly distributed in the steel, and a technique of free-cutting spherical graphite cast iron capable of further improving machinability and mechanical properties is provided.

In the Patent Document 3 (JP 2003-286538 A), by controlling the amount of Bi added to ductile cast iron material, graphite is refined and mechanical properties are improved. In this technique, tensile strength is 450 MPa or more and elongation is 20% or more by the synergistic action of Bi and Ca, spherical graphite is measured at least 2,000 particles/mm$^2$ or more, and the spheroidization ratio is maintained at 90% or more.

In the Patent Document 4 (JP 2000-045011 A), a casting method of spherical graphite cast iron, in which C is contained from 3.10 to 3.90%, Si is contained from 2.5 to 4.00%, Mn is contained 0.45% or less, P is contained 0.05% or less, Bi+Sb+Ti is contained 0.1% or less, and a superfine graphite tissue is contained in a cast, produced by a metal mold casting method is disclosed. Thereby, a spherical graphite cast iron casting, which has an ultrafine graphite tissue having a graphite particles number of approximately 1900 particles/mm$^2$ and prevents generation of chill tissue has been provided.

On the other hand, from the viewpoint of eliminating chill. The Non-Patent Document 1 ("cast iron seen from the reaction theory") shows a relationship between a nitrogen content in a molten metal and a depth of chill. Nitrogen is classified as hydrochloric acid soluble nitrogen and hydrochloric acid insoluble nitrogen, and the relationship with each chill depth is shown (Non-Patent Document 1, p. 116-123).

However, there are cases where this classification does not necessarily apply. Then, in the Non-Patent Document 2, attempts have been made to classify nitrogen as free nitrogen and other nitrogen and reduce the chill length by controlling an amount of free nitrogen. Here, the free nitrogen amount is the nitrogen amount obtained by subtracting the inclusion nitrogen amount, which is inclusive, from the total nitrogen amount. The amount of inclusion nitrogen is measured by JIS G 1228 (distillation-neutralization titration method).

In the Non-patent document 3, as-cast products with the number of spherical graphite without chill being 850-1400 particles/mm$^2$ are provided (Non-Patent Document 3, Table 1 and Upper Column 1).

PRIOR ART DOCUMENTS

Patent Documents

Patent Document 1 JP H01-309939 A
Patent Document 2 JP H06-093369 A
Patent Document 3 JP 2003-286538 A
Patent Document 4 JP 2000-045011 A
Patent Document 5 JP 2012-157886 A

Non-Patent Documents

Non-Patent Document 1 "Cast iron as seen from the reaction theory", published by Shin Nihon & Co., Japan cast forging Association on Mar. 31, 1992

Non-Patent Document 2 "Influence of Free Nitrogen Amount on Graphite Solidification of Cast Iron", Japan Casting Engineering Society, Summary of the 163nd National Concert Tournament (2013) 99

Non-Patent Document 3 "Magnesium Map of the spherical Graphite Structure in DuctiLe Castlrons" REVIS TA DE METALURGIA, 49 (5) SEPTEMBREOCTUBRE 325-339 2013

Non-Patent Document 4 "Chillless metal mold casting of spherical graphite cast iron", Japan Foundry Enginerring Society, Summary of the 166th National Performance Competition (May 2015) 95

Non-Patent Document 5, 2008 Strategic Infrastructure Improvement Support Project "Development of ultra-thin casting technology for weight reduction of automotive casting parts"

DISCLOSURE OF THE INVENTION

Problems to be Solved by the Invention

In the conventional techniques described in the above-mentioned patent documents and non-patent documents, when a metal mold casting is carried out, chill is generated in any case. Heat treatment must be carried out in order to eliminate chill.

In addition, the number of spherical graphite in the tissue of the spherical graphite cast iron produced by the above production method is small. Therefore, mechanical properties such as strength and elongation are not necessarily desired.

In addition, in the technique of the Patent Document 3, generation of white powder, which is thought to be oxide, is recognized, and then this technique lacks elongation characteristics.

In the Non-Patent Document 2, because the chill length is influenced by the amount of free nitrogen, reduction of chill length is aimed at by removing free nitrogen. However, the technique described in the Non-Patent Document 2 is not a metal mold casting although it contains chiller, and number and particle sizes of the spherical graphite in the tissue are not mentioned.

In spherical graphite cast iron described in the Patent Document 3, the number of spherical graphite is achieved 2,000 particles/mm$^2$ or more. However, this technology is not the technique of the metal mold casting. That is, there is no provision of metal mold cast products having the number of spherical graphite of 2,000 particles/mm$^2$ or more.

In the Patent Document 4, Bi and Sb are indispensable.

In the Non-Patent Document 3, only the brake caliper G (7.5 kg, wall thickness 43 mm) is the item without chills on the surface and the center among the metal mold cast products, and the modulus M (cm) (M=V/S, V is the volume, S is the surface area) is limited to those exceeding 2.

In the Non-Patent Document 4, spherical graphite cast iron having a large amount of ultrafine spherical graphite is provided as compared with the prior art. Spherical graphite cast iron with finer spherical graphite and less variation in its particle diameter is desired. Also, spherical graphite cast iron with better mechanical properties, especially impact value, is desired.

In the present invention, by applying the chilling control technique with free nitrogen and semi-solid casting technique, refinement of semi-solidified ductile cast iron and improvement of the number of graphite particles, which were impossible to carry out graphitization without heat treatment in the conventional semi-molten/semi-solid die casting method, were done as a result of efforts.

An object of the present invention is to provide a casting method and cast product of spherical graphite cast iron, in which, even with a small modulus, there is no chill, the spherical graphite in the tissue is further made ultrafine, the dispersion of the particle diameter is small, and the number of the particles is several times that of the conventional one in the as cast state where heat treatment is not carried out.

Means for Solve the Problems

The invention according to claim 1 is a semi-solid casting method of a spherical graphite cast iron comprised from;

a melting process, in which raw material composed of cast iron is melted and original molten metal is obtained;

a spheroidizing treatment process, in which the original molten metal is spheroidized;

an inoculation process, in which an inoculant is added to the spheroidized original molten metal; and a casting process, in which the original molten metal after the inoculation process is poured and filled up to a product space through a gate of a metal mold;

wherein the original molten metal before being filled up to the product space is controlled to a semi-solidification temperature range.

The invention according to claim 2 is the semi-solid casting method of the spherical graphite cast iron according to claim 1, wherein an amount of nitrogen at the time of melting of the cast iron is controlled to 0.9 ppm (mass) or less.

The invention according to claim 3 is the semi-solid casting method of the spherical graphite cast iron according to claim 1 or 2, wherein the semi-solidification temperature range is set before the gate by controlling the amount of heat released from the molten metal.

The invention according to claim 4 is the semi-solid casting method of the spherical graphite cast iron according to any one of claims 1 to 3, wherein a temperature of the raw material when passing through the gate is controlled to a constant temperature in the semi-solidification temperature range.

The invention according to claim 5 is the semi-solid casting method of the spherical graphite cast iron according to any one of claims 1 to 4, wherein the pouring temperature is controlled to (melting point+40° C.) or less.

The invention according to claim 6 is the semi-solid casting method of the spherical graphite cast iron according to any one of claims 1 to 5, wherein a temperature of the raw material when passing through the gate is set to 1140-1170° C.

The invention according to claim 7 is the semi-solid casting method of the spherical graphite cast iron according to any one of claims 1 to 6, wherein a cooling rate of the molten metal from the pouring temperature to a liquidus line passing temperature is controlled to 20° C./sec. or faster.

The invention according to claim 8 is the semi-solid casting method of the spherical graphite cast iron according to any one of claims 1 to 7, wherein a pressurization is carried out after the filling up.

The invention according to claim 9 is the semi-solid casting method of the spherical graphite cast iron according to any one of claims 1 to 8, wherein the raw material composed of the cast iron is melted and the original molten metal is obtained; oxygen is removed from the original molten metal by heating the original molten metal to a predetermined temperature of 1500° C. or more, stopping the heating, and maintaining the stopped temperature for a certain period of time; nitrogen in the original molten metal is reduced by gradually cooling the original molten metal; the spheroidizing treatment is carried out; the inoculation is carried out; and the casting is carried out.

The invention according to claim 10 is the semi-solid casting method of the spherical graphite cast iron according to any one of claims 1 to 9, wherein the spheroidizing treatment is carried out with an oxygen content being 20 ppm (mass) or less.

The invention according to claim 11 is the semi-solid casting method of the spherical graphite cast iron according to any one of claims 1 to 10, wherein a heat insulating coating is applied to a surface of the metal mold.

The invention according to claim 12 is the semi-solid casting method of the spherical graphite cast iron according to claim 11, wherein a thickness of the heat insulating coating is 0.2 mm or more.

The invention according to claim 13 is the semi-solid casting method of the spherical graphite cast iron according to any one of claims 1 to 12, wherein the heat insulating coating, whose thermal conductivity is 0.42 W/mk or less, is applied to the surface of the metal mold.

The invention according to claim 14 is a semi-solid metal mold cast product of a spherical graphite cast iron, wherein the cast iron does not include Bi; a modulus of the cast does not exceed 2 cm; and the semi-solid metal mold cast product does not include chill, and has a part of tissue, in which a number of the spherical graphite is 500 particles/mm$^2$ or more, and the spherical graphite having a particle size of 4-7 μm is 80% (number proportion) or more, in as cast state.

The invention according to claim 15 is a semi-solid metal mold cast product of a spherical graphite cast iron, wherein the cast iron does not include Bi; a modulus of the cast does not exceed 2 cm; and the semi-solid metal mold cast product has a part of tissue, in which a number of the spherical graphite is 1000 particles/mm$^2$ or more, and the spherical graphite having a particle size of 4-7 μm is 80% (number proportion) or more, in as cast state.

The invention according to claim 16 is a semi-solid metal mold cast product of a spherical graphite cast iron, wherein the cast iron does not include Bi; and the semi-solid metal mold cast product has a part of tissue, in which a number of the spherical graphite is 1500 particles/mm$^2$ or more, and the spherical graphite having a particle size of 4-7 μm is 80% (number proportion) or more, in as cast state.

The invention according to claim 17 is a semi-solid metal mold cast product of a spherical graphite cast iron, having a part of tissue, in which a number of the spherical graphite is 2000 particles/mm$^2$ or more, and the spherical graphite having a particle size of 4-7 μm is 80% (number proportion) or more, in as cast state.

The invention according to claim 18 is a semi-solid metal mold cast product of a spherical graphite cast iron, having a part of tissue, in which a number of the spherical graphite is 3000 particles/mm$^2$ or more, and the spherical graphite having a particle size of 4-7 μm is 80% (number proportion) or more, in as cast state.

The invention according claim 19 is a semi-solid metal mold cast product of a spherical graphite cast iron, having a tissue not including chill; and having a part of tissue, in which a number of the spherical graphite is 3000 particles/mm$^2$ or more, and the spherical graphite having a particle size of 4-7 μm is 80% (number proportion) or more, in as cast state.

The invention according to claim 20 is the semi-solid metal mold cast product of a spherical graphite cast iron according to any one of claim 14 to 19, wherein the modulus of the cast is 2.0 cm or less.

The invention according to claim 21 is the semi-solid metal mold cast product of a spherical graphite cast iron according to any one of claims 14 to 19, wherein the modulus of the cast is 0.25 cm or less.

Effects of the Invention

According to the present invention, following contents becomes possible. Even with a small modulus, there is no chill, the spherical graphite in the tissue is further made ultrafine, the dispersion of the particle diameter is small, and the number of the particles is several times that of the conventional one in the as cast state where heat treatment is not carried out.

DESCRIPTION OF EMBODIMENTS

Figure 1:
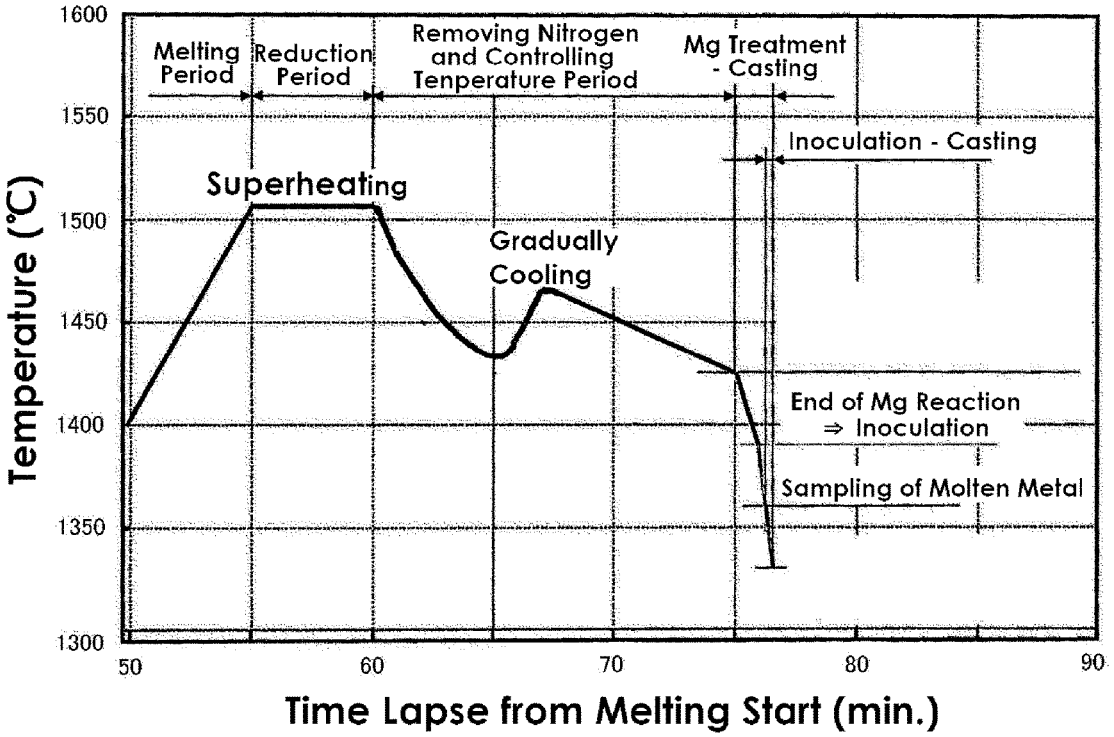
FIG. 1 shows a graph indicating steps of a reference example.

Hereinafter, an embodiment for carrying out the present invention is described with reference to FIG. 1.

(Melting Process)

In a melting process, raw material, which become an original molten metal, of spherical graphite cast iron are melted. As the above raw material, for example, pig iron, steel scraps and scraps of the material specified in JISG5502 may be used. Other cast irons are also applicable. In addition, other elements may be added as necessary. Further, the composition range may be appropriately changed. As an example specified in JISG5502, FCD400-15, FCD450-10, FCD500-7, FCD600-3, FCD700-2, FCD800-2, FCD400-15, FCD450-10, FCD500-7 and the like can be cited.

In addition to the above components, Bi, Ca, Ba, Cu, Ni, Cr, Mo, V and RE (rare earth element) may be appropriately added to the raw material or after melting the raw material.

Further, CE (equivalent carbon content) may be appropriately controlled, for example, from 3.9 to 4.6.

In the present invention, heating is further carried out to raise the temperature of the original molten metal after melting. Oxygen is removed from the original molten metal by raising the temperature.

Temperature rise is carried out until the temperature T0, at which the elimination of oxygen from the original molten metal stops. Temperature rising is stopped when the temperature is reached to T0, and the temperature is kept for a predetermined time at TO. When temperature is kept, generation of air bubbles is recognized from the side of the crucible. At this point, a keeping temperature is stopped. Normally, the keeping temperature is carried out between 2 and 10 minutes.

(Removing Nitrogen Process)

After removing the oxygen, nitrogen is removed.

The Non-Patent Document 2 controls free nitrogen. However, the Non-Patent Document 2 is intended for a sand mold, and it can not be applied as it is to a metal mold. Even if free nitrogen control described in the Non-Patent Document 2 is carried out in the metal mold, an increase in the number of spherical graphite is not necessarily observed.

In the case of the metal mold, it was found that when nitrogen was controlled based on an amount of nitrogen generated at the time of melting, it was possible to control the increase in the number of spherical graphite without a chill generation.

The amount of nitrogen generated at the time of melting is the amount of nitrogen gas at the time of melting when the cast product is melted. It is specifically measured by the following procedure. To remove the oxide film of the cast product, the oxide film on the surface is removed by FUJI STAR 500 (Sankyo Rikagaku) sandpaper until metallic luster is obtained, and the cast product is cut with a micro cutter or a reinforcing bar cutter to obtain 0.5-1.0 g of samples. The cut samples are washed with acetone for oil removal, dried for several seconds with a dryer or vacuum dried, and then analyzed.

In beginning of the analysis, power is supplied to an equipment, He gas is sent, system check and leak check are carried out, and it is confirmed that there is no abnormality. After stabilization, analysis is started. For analysis, discard analysis and blank measurement are carried out to carry out zero point correction.

For the blank measurement, a crucible is firstly set. About 0.4 g of a combustion improver (graphite powder) is added (The purpose of the combustion improver improves the nitrogen extraction rate in the alloy). Outing gas and purging are carried out while introducing He gas, and an interior of a sample chamber is replaced with He gas. Next, In order to remove oxygen and nitrogen generated from the graphite crucible by preliminary heating, heating is maintained for 15 seconds at an analysis temperature (2163° C.) or higher to remove gas generated from the crucible. Thereafter, analysis is carried out under heating condition, and numerical value obtained is set to blank and correction is carried out so as to be a zero point base.

As standard samples for preparing calibration curve, LECO 114-001-5 (8±2 ppm nitrogen, 115±19 ppm oxygen), 502-873 (47±5 ppm nitrogen, 35±5 ppm oxygen), 502-869 (414±8 ppm nitrogen, 36±4 ppm oxygen) and 502-416 (782±14 ppm nitrogen, 33±3 ppm oxygen) are used. Measurements are carried out three times for each sample, and a calibration curve is prepared from the obtained numerical values.

In the temperature elevation analysis, it slowly dissolves from the low melting point material, and nitrogen contained in the melted material is extracted for each temperature, and a wave peak is obtained.

An amount of nitrogen per unit area are calculated from a total area of wave peak (sum of peak intensity value) and an amount of nitrogen obtained by analysis, and a peak (A1) generated at an initial temperature rise around 1250-1350° C. is quantified as a nitrogen amount at melting.

In addition to the relationship between a so-called free nitrogen itself, a chill generation and a number of spheroidized graphite particles, a causal relationship between a nitrogen amount chill generation during melting and a number of spheroidized graphite particles is found out. The present invention controls the nitrogen amount chill generation during melting and the number of particles of spheroidized graphite by controlling the amount of melting nitrogen.

About the nitrogen, it can be removed from the original molten metal by decreasing the solubility in the original molten metal. For this purpose, the molten metal is slowly cooled. In the case of rapid cooling, nitrogen may not be completely removed from the original molten metal. The cooling rate is preferably 5° C./min or less.

The cooling is preferably carried out to T (° C.) in the equation 1. When the cooling is performed to a temperature lower than T (° C.), oxygen consumption starts on the contrary. It is preferable to cool down to T<° C.> in order to minimize both nitrogen and oxygen. The equation 1 is an equilibrium equation. By considering a non-equilibrium practical point, it is preferable to cool down to (T−15° C.)±20 (° C.).

$$T = Tk - 273 (^\circ \text{C.})$$

$$\log([\text{Si}]/[\text{C}]2) = -27.486/Tk + 15.47 \qquad \text{Equation (1)}$$

(Spheroidizing Treatment Process)

At the point of cooling to T (° C.) in the equation 1, spheroidizing treatment is carried out.

The spheroidizing treatment is generally carried out by addition of Mg. Other methods (for example, spheroidizing treatment with a treating agent containing Ce) may be used.

However, in the case of Mg, the degree of refinement and the number of spherical graphite per unit area are overwhelmingly superior compare to Ce.

The Mg-containing treatment agent is preferably Fe—Si—Mg. In particular, it is preferable to use a treating agent having Fe:Si:Mg=50:50:(1 to 10) (mass ratio). When the Mg ratio is less than 1, sufficient spheroidization can not be carried out. On the other hand, if it exceeds 10, bubbling will be generated and gas entrapment will be generated. From this viewpoint, the Mg ratio is preferably 1 to 10, and more preferably 1 to 5.

When the oxygen content is 20 ppm (mass) or less, the spheroidizing treatment is preferably carried out. When the oxygen content is 20 ppm or less, finely spherical graphite can be obtained.

(Inoculation Process)

Inoculation is carried out after the spheroidizing treatment. Inoculation is carried out by adding, for example, Fe—Si to the molten metal. For example, Fe-75Si (mass ratio) is preferably used.

(Casting Process)

After adding inoculant Fe—Si, casting is carried out. It is preferable to carry out the casting in a state, in which the inoculant is not diffused and stirred. It is preferable to shorten the time to, for example, 5 minutes or less, 3 minutes or less, 1 minute or less, 30 seconds or less, in consideration of facility factors and the like.

The casting is preferably performed at Tp±20 (° C.).

$$Tp = 1350 - 60M (^\circ \text{C.})$$

$$M = V/S$$

V is product volume ($cm^3$), S is product surface area ($cm^2$).

The metal mold temperature is preferably Td±20 (° C.).

$$Td = 470\text{-}520M (^\circ \text{C.})$$

$$M = V/S$$

V is product volume ($cm^3$), S is product surface area ($cm^2$).

It is preferable to control the metal mold temperature according to the volume of the product. Spherical graphite can be formed more finely and uniformly by controlling the metal mold temperature.

However, depending on the conditions, there is a fear of causing poor molten metal circulation, so the minimum temperature of the metal mold is preferably 100° C.

The inoculation treatment is preferably carried out by adding Fe—Si.

As for the time from the inoculation to the casting, it was considered preferable to be short. That is, it was thought as follows.

It is preferable that the casting is carried out as soon as possible after the addition of Fe—Si. If the time after the inoculation becomes short, the spherical graphite become fine and number of them per unit area increases. As the time is short, the diffusion of Fe—Si into the molten metal becomes slower, and then the density of the spheroidized graphite increases accordingly.

Depending on the apparatus and the like, for example, it is preferable to carry out the casting within 5 minutes, more preferably within 3 minutes, and within 30 seconds, 5 seconds or shorter, it is preferable to make it shorter. When the casting is carried out in a state before diffusion after dissolving Fe—Si, the number of spheroidized graphite is dramatically increased as compared with the case where it is uniformly dissolved. There is not the chill generation, too. In order to further promote such a condition, it is preferable to carry out the casting without the diffusion.

However, in the present invention, even when 5 minutes or more have elapsed after the inoculation, the same result as in the case of within 3 minutes can be obtained. Conventionally, in order to shorten the time to casting, various restrictions were imposed on the operation. However, if it is unnecessary to shorten the time from the inoculation to the casting, it is possible to perform work with high degree of freedom without receiving such restrictions. The effect of inoculation is generally thought to be burned off after 10 minutes from the inoculation treatment. Therefore, in the present invention, it is suggested that the inoculation can be omitted.

It is preferable to apply a heat insulating coating to the metal mold. Specifically, a heat insulating coating is preferable, and a thermal conductivity of 0.42 W/mk or less is particularly preferable. Specifically, it is preferable to apply the heat insulating coating to a thickness of 0.2 mm or more.

EXAMPLES

Examples of the present invention are described below together with reference examples.

The reference examples are examples, in which the basic part is common to the present invention's examples.

Reference 1

A raw material having the following composition (mass %) was used.

C: 3.66, Si: 2.58, Mn: 0.09, P: 0.022, S: 0.006, Remaining Fe

The T of the formula (1) in the composition of this raw material is obtained as follows.

$$Tk=1698(K)$$

$$T=Tk-273=1425(^\circ\ C.)$$

This raw material was melted by heating in a furnace. Heating was continued even after melting, passed through 1425° C., and the temperature raising was continued. At a temperature of 1425° C. or higher, oxygen is removed.

As the temperature was further increased, generation of oxygen from a heat-resistant material of the furnace was observed at a temperature exceeding 1510° C. Therefore, the temperature rise was stopped at 1510° C., and the temperature was kept at 1510° C. for 5 minutes. During this period, oxygen is removed from original molten metal.

After maintaining at 1510° C. for 5 minutes, the original molten metal was gradually cooled to 1425° C. (=T ° C.) at a rate of about 5° C./min. On the way, the temperature was temporarily lowered to 1440° C., then increased to 1460° C., and then cooled at a rate of 5° C./min.

As the temperature of the molten metal decreases, the solubility of nitrogen in the molten metal decreases, and then supersaturated nitrogen is generated. The amount of saturation of nitrogen in the molten metal decreased by the slow cooling, and unsaturated nitrogen was released from the molten metal. When cooling to the temperature of T, a part of the molten liquid was taken out and the oxygen content was analyzed. This content was 20 ppm or less.

Next, an Mg treatment was carried out. The Mg treatment was carried out by adding Fe—Si—3% Mg. After the Mg treatment, an inoculation was carried out. A molten metal surface inoculation was carried out with 0.6 mass % Fe—75Si, and stirred. A product is a coin with a diameter of 37 mm and a thickness (t) of 5.4 mm. A casting temperature and a metal mold temperature were set as follows.

Also, 0.4 mm of heat insulating coating was applied to the metal mold. The thermal conductivity of the coating was 0.42 W/mk.

The casting temperature was as follows.

$$M=V/S=0.34$$

$$Tp=1300-60M=1320^\circ\ C.$$

The metal mold temperature was as follows.

$$Td=470-520M=293.2(^\circ\ C.)$$

Casting was performed in the mold 10 seconds after the end of the inoculation under the casting temperature and the metal mold temperature set as above. After casting, the following results were obtained.

The composition (mass %) of the product was as follows.

C:3.61, Si: 3.11, Mn:0.10, P:0.024, S:0.008, $M_g$:0.018

Figure 2:
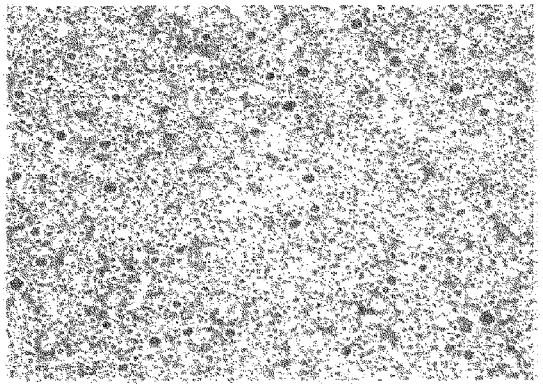
FIG. 2 shows tissue views of the products produced by a reference example (a) and a sand mold (b).
Figure 2:
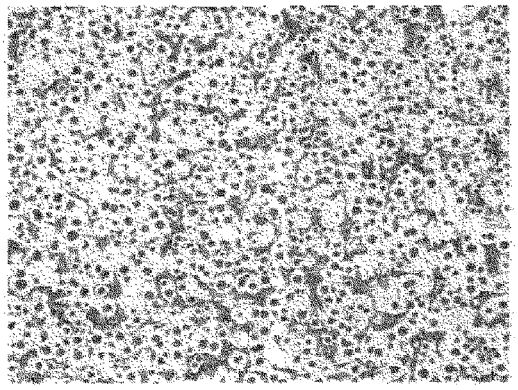
Figure 3:
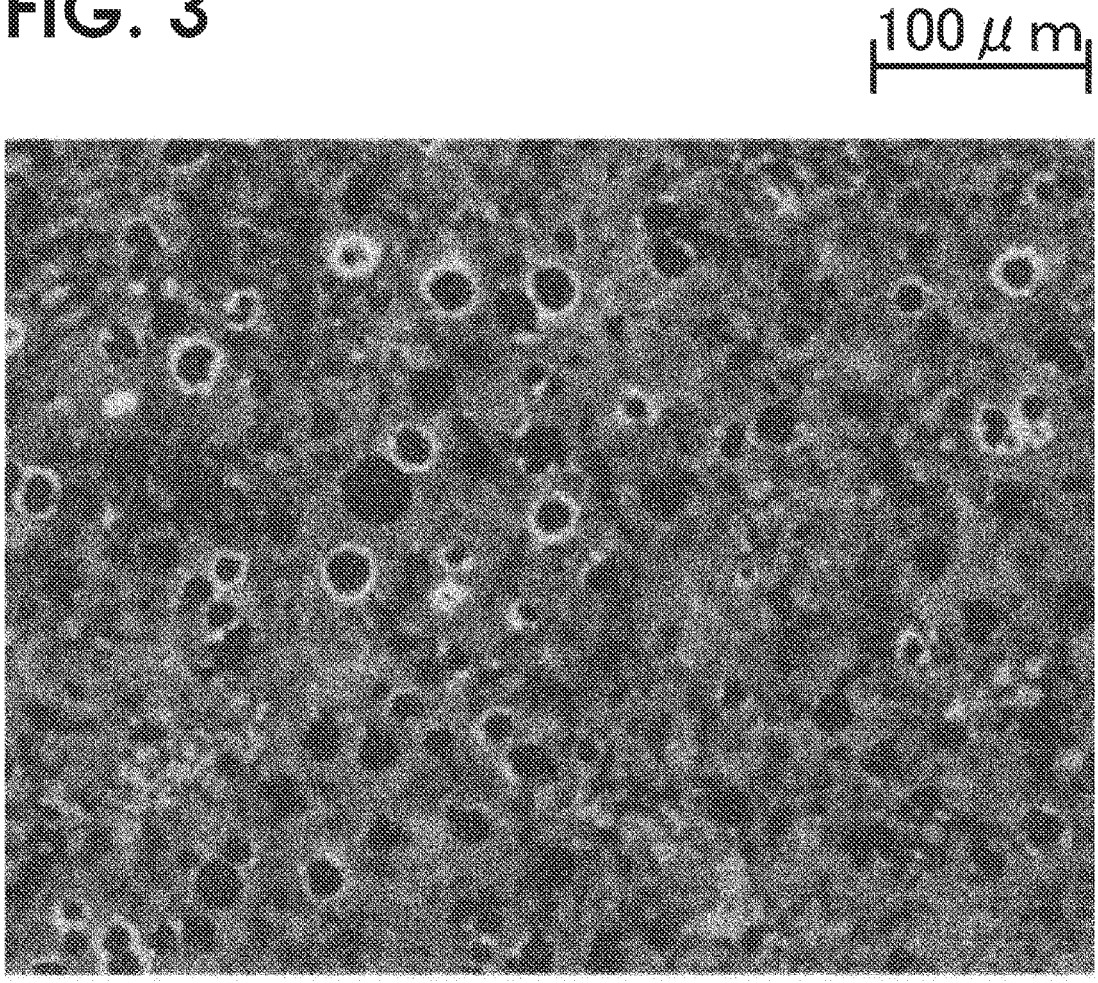
FIG. 3 shows a metal tissue view of a conventional spherical graphitized cast iron.
Figure 4:
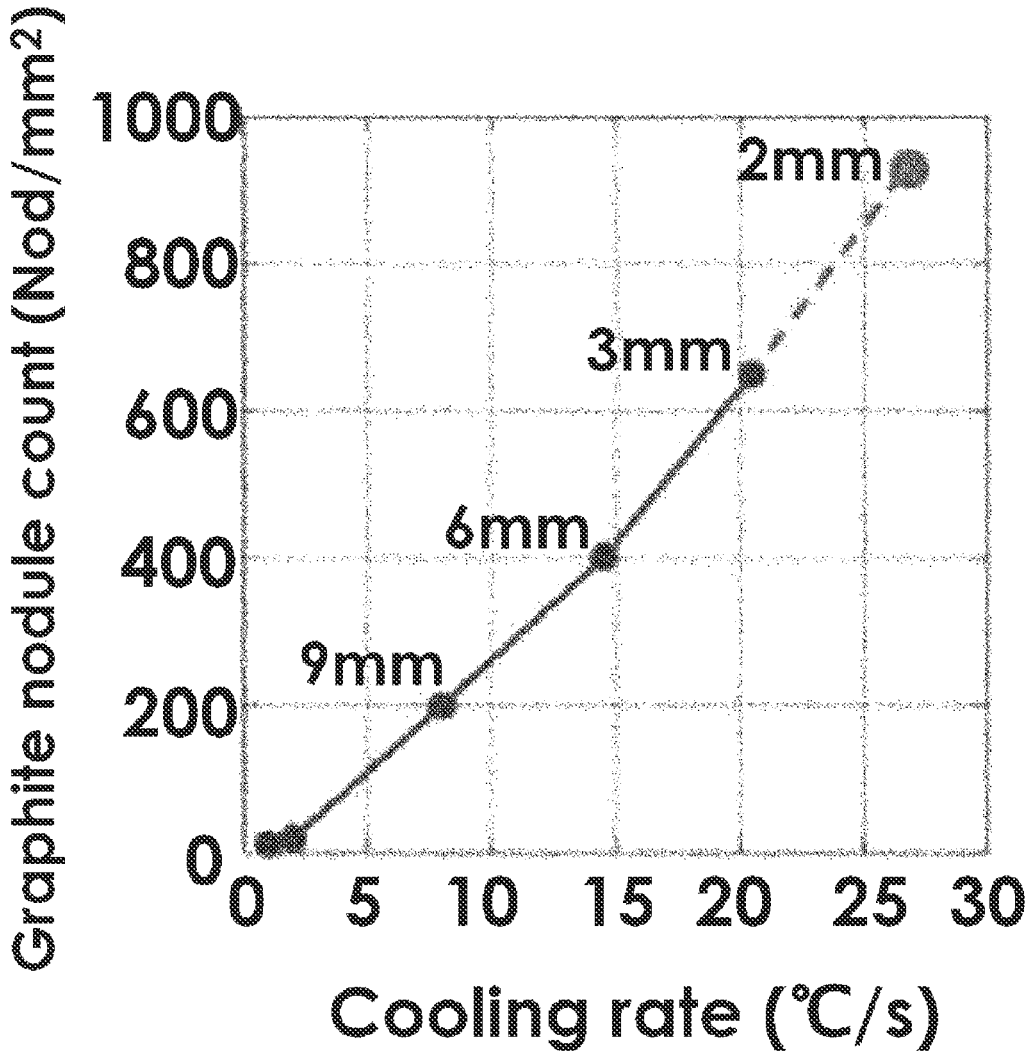
FIG. 4 shows a graph indicating a relationship between a cooling rate and a critical number of chilled particles.
Figure 5:
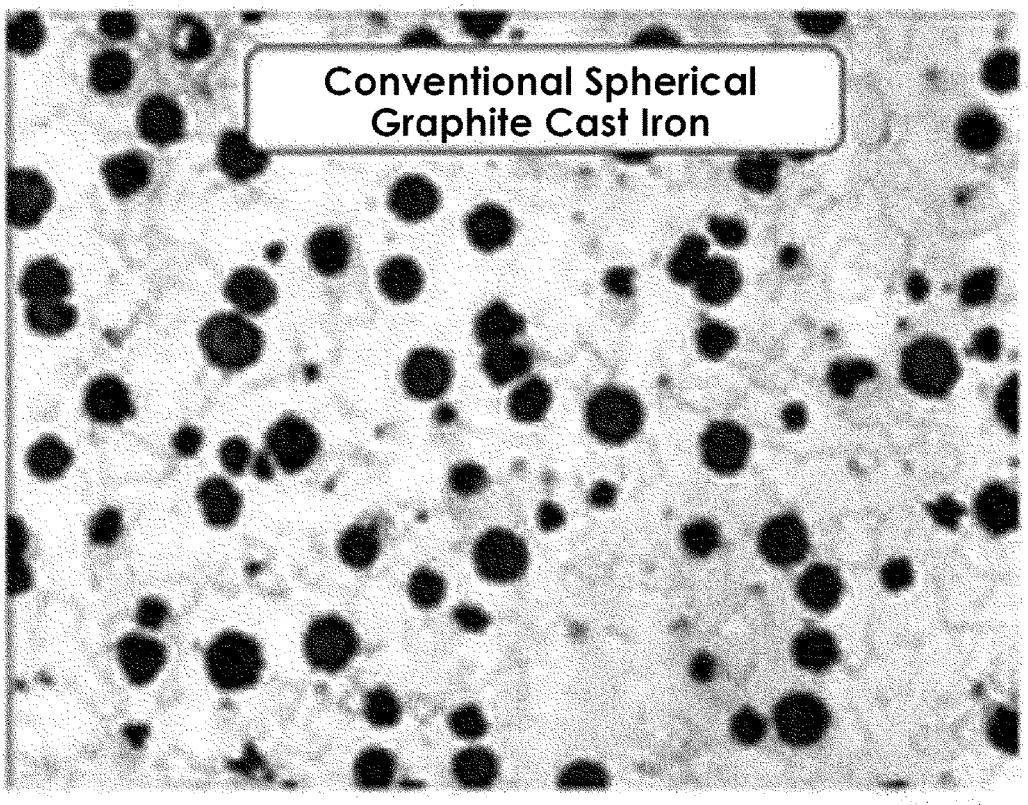
FIG. 5 shows a photograph of a metal tissue of a conventional spherical graphite cast iron and a number of graphite particles.

A tissue of a sample after casting was observed with a microscopic photograph. A tissue view is shown in FIG. 2(*a*). FIG. 2(*b*) is a reference example of a sand mold cast product.

The spherical graphite were very fine and uniformly distributed. When the number of spheroidized graphite was counted, the number was 3222 particles/mm$^2$. There was no chill generation at all.

Reference 2

In this example, the amount of nitrogen generated during melting was varied, and the relationship between the amount of nitrogen generated during melting and the generation of chill was examined.

The experiment was carried out in the same manner as in Example 1. In each case, a 0.4 mm thick heat insulating coating was formed on the metal mold surface. Results were as follows.

| Amount of nitrogen generated during melting (ppm) | T (° C.) | Casting temperature (° C.) | Chill generation |
|---|---|---|---|
| 1.05 | 1415 | 1303 | Generated |
| 1.15 | 1439 | 1436 | Generated |
| 0.89 | 1430 | 1316 | Not generated |
| 0.93 | 1429 | 1390 | Generated |
| 0.22 | 1432 | 1310 | Not generated |
| 0.63 | 1432 | 1315 | Not generated |
| 0.37 | 1430 | 1312 | Not Generated |

As shown in the above results, 0.9 ppm of the amount of nitrogen generated at the time of melting was regarded as a critical value. And, when controlled to the critical value or less, no chill was generated.

In the case where there are no chill generation, the number of spheroidal graphite was much larger than that in the case of chill generation.

Comparative Example

In this example, after melting raw material, the temperature was raised to 1510° C. and then the molten raw material was cast into a mold.

However, sand mold was used in this example.

The other points were the same as in example 1.

Figure 6:
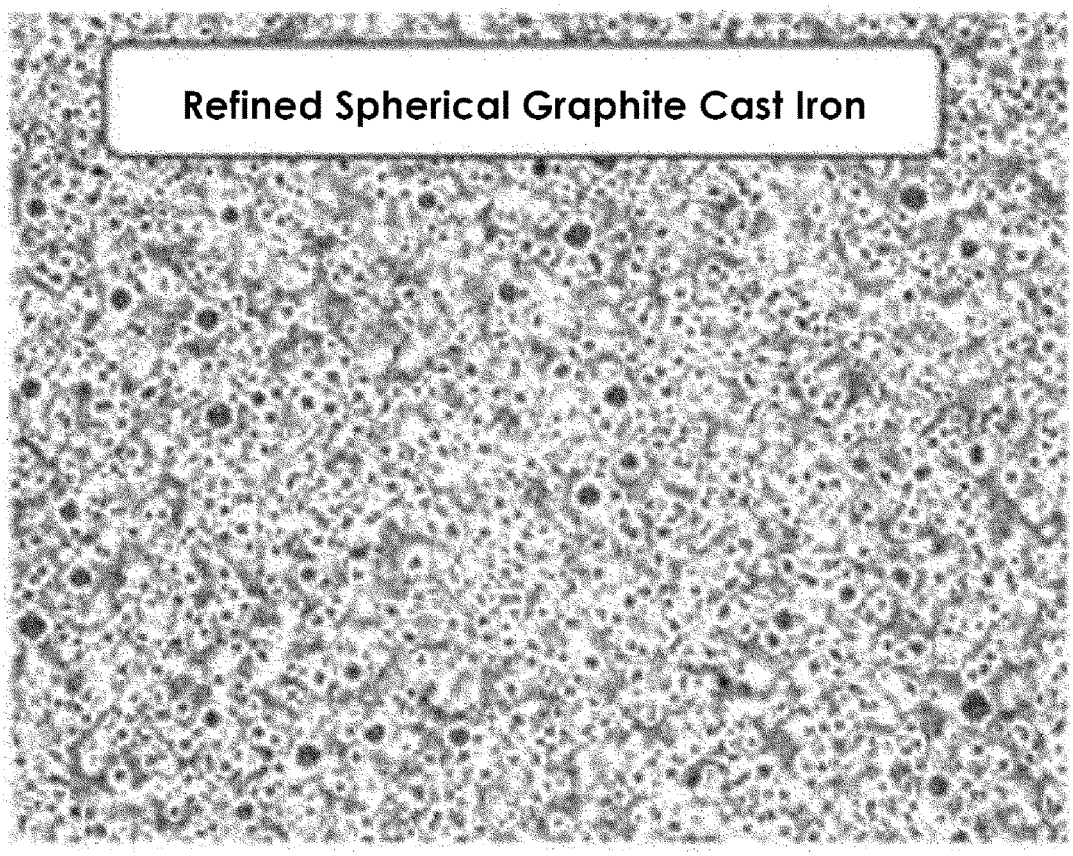
FIG. 6 shows a metal tissue photograph of a ultrafine spherical graphite cast iron.

The results are shown in FIG. 2(*b*) and FIG. 6.

In this example, it was 1005 particles/mm$^2$.

In this example, experiments were carried out with different coatings.

The experiments were carried out about following three kind of coatings. The other conditions are the same as in Example 1.

A Heat insulating coating (thickness 0.4 mm), Thermal conductivity: 0.42 W/mk

B Heat insulating coating (thickness 0.7 mm), Thermal conductivity: 0.2 W/mk

C Heat insulating coating (thickness 0.2 mm), Thermal conductivity: 0.85 W/mk

D Carbon black, Thermal conductivity: 5.8 W/mk

A is the same as in the Reference 1.

In the case of the heat insulating coating (A-C), chill was not observed. However, when the thickness was 0.2 mm, the number of the spherical graphite was greater than in the case of 0.4 mm and the particle size was small. In the case of 0.7 mm, it was almost the same as 0.4 mm.

Also, in the case of carbon black, chill was not observed, but the number of spheroidal graphite was further smaller than in the case of 0.2 mm thick heat insulating coating.

Reference 4

In this example, the metal mold temperature was varied in the range of 25° C. to 300° C.

The test was carried out at five points of 25° C., 178° C., 223° C., 286° C. and 300° C.

The heat insulating coating was applied 0.4 mm.

The other points were the same as in the Reference 1.

In the case of 25° C., chill formation was observed. For other temperatures, chill formation was not observed. In the case of 286° C., the particle diameters were the smallest.

Reference 5

In this example, the metal mold cast product was produced by changing the modulus (M) within the range of 0.25 to 2.0 (cm).

The production conditions are the same as in the Reference 1.

The number of spheroidal graphite was measured for the each metal mold cast product.

Chill formation was not found in any of the products.

Even when the modulus (M) is small, tissues having fine spherical graphite of 1500 particles/mm$^2$ or more were observed.

Reference 6

In this example, a knuckle was experimentally produced and its mechanical properties were evaluated.

In this example, a filter was installed in the sprue to remove foreign matter as much as possible. However, there was slight foreign matter remained.

Evaluation of the mechanical properties of the knuckle experimentally produced was a result indicating the mechanical properties of cast steel products nevertheless being a material of spherical graphite cast iron. For example, the tensile strength of 525 N/cm$^2$ product, which is one of knuckle experimentally produced, has elongation of 18.8%. In general spherical graphite cast iron, because the tensile strength is around 380 N/cm$^2$ when comparing with the same elongation, the tensile strength becomes 1.5 times that of the conventional spherical graphite cast iron, and mechanical properties comparable to cast steel were obtained.

Example 1

First, we tried semi-solidified metal mold casting under gravity and confirmed the castability such as chill and shrinkage formation degree, casting surface, dimensional accuracy and so on.

Original molten metal was produced in a 25 kg high frequency induction furnace, and in-furnace spheroidizing treatment was carried out with a plunger at −15° C. below the critical equilibrium temperature of $CO/SiO_2$ after superheating.

As the spheroidizing agent, low N system Fe—Si-3Mg was used. After that, tapping stream inoculation was carried out with Ca type Fe-75Si. The target chemical constituents of the casting molten metal are shown below.

| Target chemical component after spherical treatment and inoculation (mass %) | | | | | | | |
|---|---|---|---|---|---|---|---|
| C | Si | Mn | P | S | | F•Mg | T•Mg |
| 3.50 | 3.30 | <0.10 | <0.020 | 0.010 | 0.015 | 0.020 | 0.025 |

It is targeted that the casting is carried out within 2 minutes from the inoculation, and the ladle temperature is 1220° C. In the process, free nitrogen removal operation similar to that in the Reference 1 was carried out with conscious of free N control.

Figure 7:
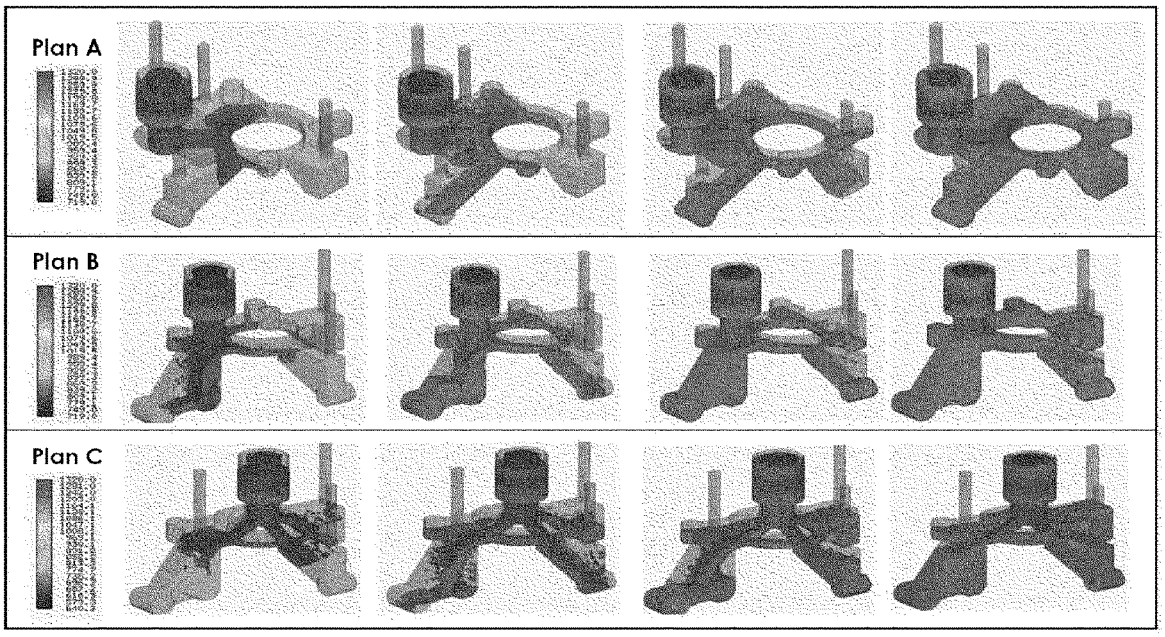
FIG. 7 shows a view indicating results of melt flow analysis of various metal mold plans.
Figure 8:
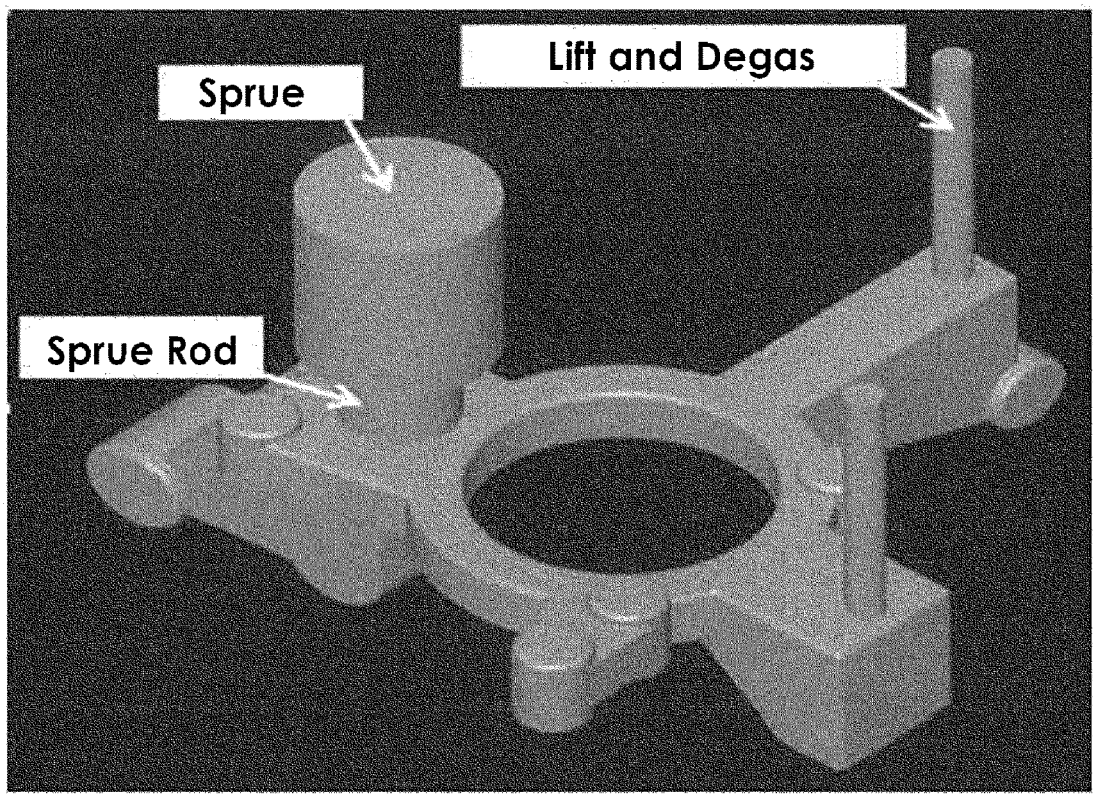
FIG. 8 shows a perspective view of a knuckle made in plan B according to an embodiment.

About metal mold design, we examined the optimum solution by analyzing the flow of molten metal by AdStefan in advance in three plans A, B and C (FIG. 7). From the analysis result of the molten metal flow, a knuckle of plan B shown in FIG. 8 was casting sample material. The casting weight is about 5.3 kg. The metal mold was produced by S50C, and basic coating and working coating were coated. Preheating was performed with an internal heater of the metal mold, and the temperature was set at 350° C. Extraction of the sample material from the metal mold was carried out at 500° C. or lower.

Figure 9:
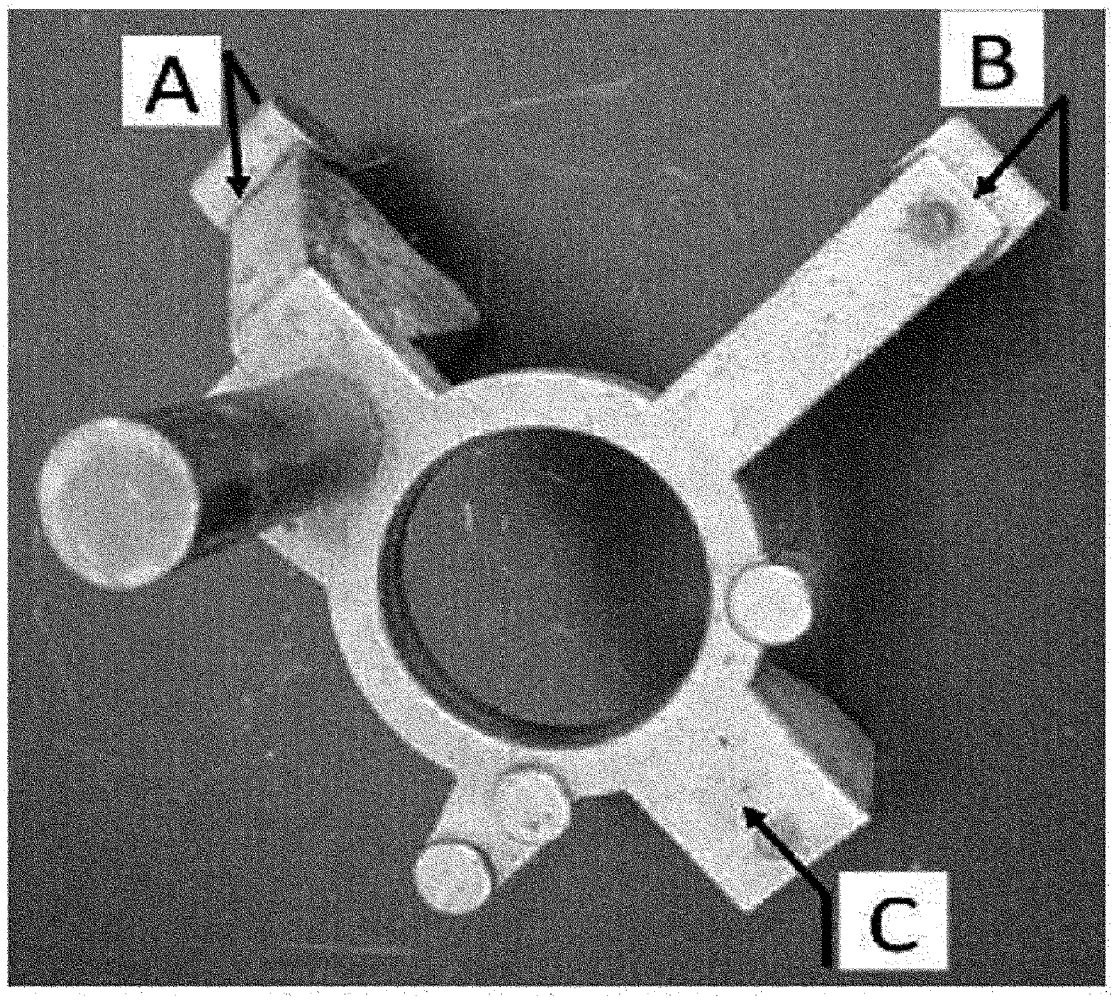
FIG. 9 shows a photograph indicating an appearance of knuckle in an as-cast state according to an embodiment.
Figure 10:
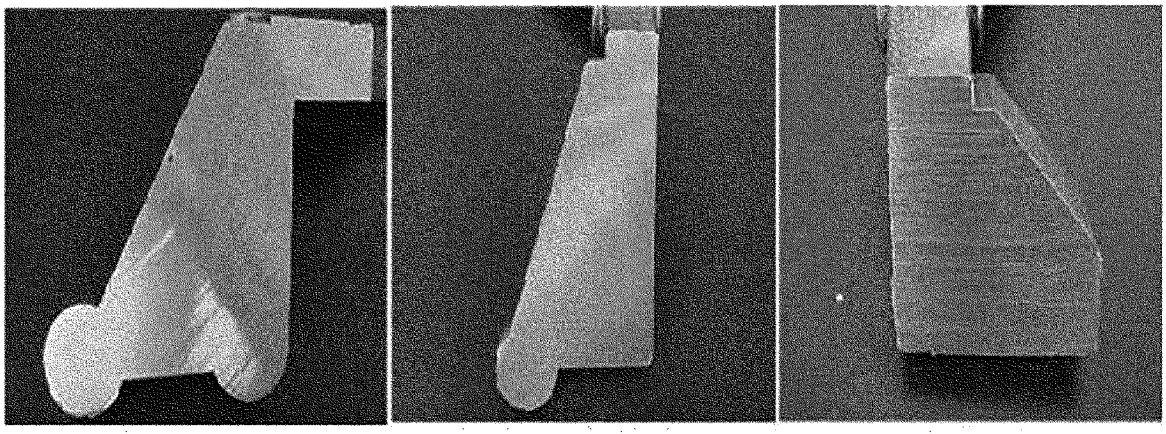
FIG. 10 shows photographs indicating a visual external view on the cutting plane of the knuckle shown in FIG. 9.
Figure 11:
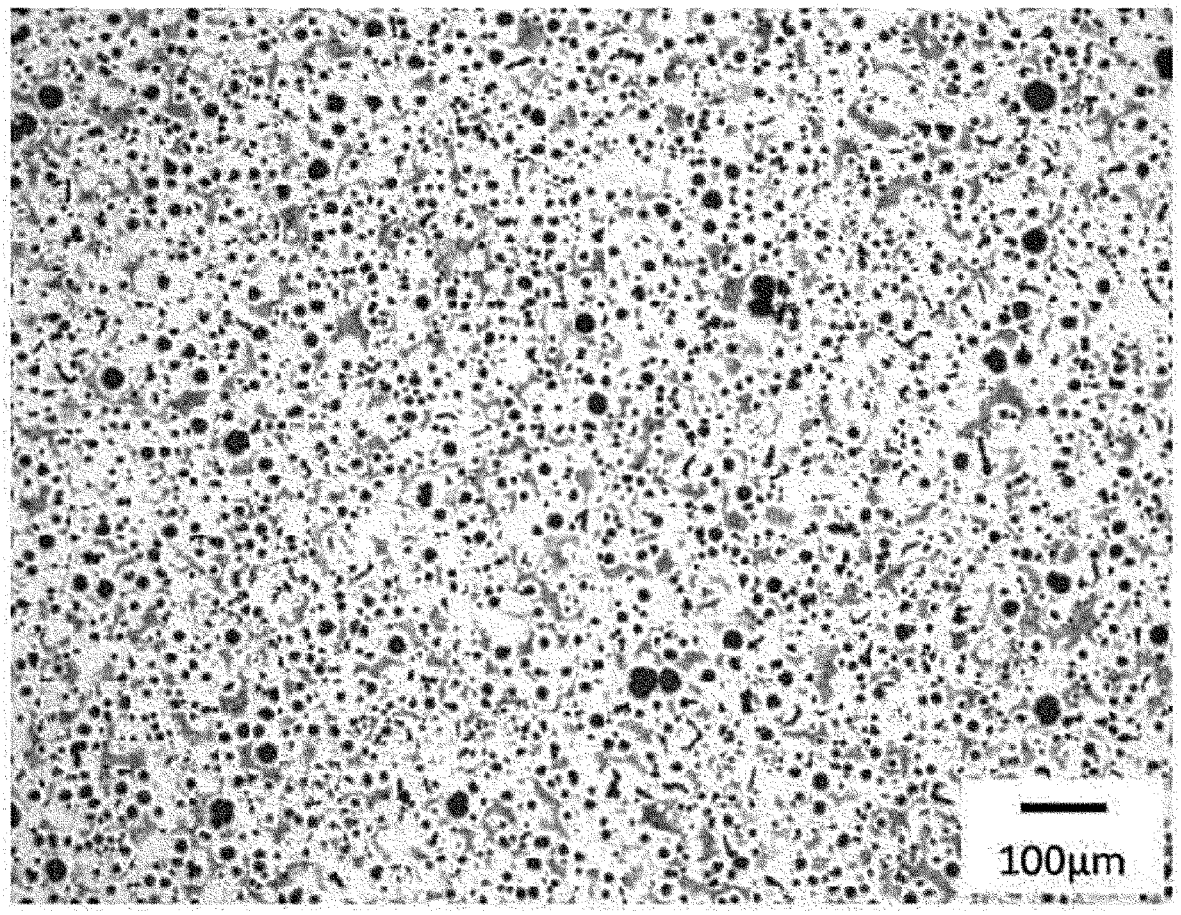
FIG. 11 shows a metal tissue photograph of the knuckle shown in FIG. 9. The number of graphite particles is 1922 particles/$mm^2$.

The appearance of the knuckle in an as-cast state is shown in FIG. 9. Although a poor quality of molten metal and dross were seen in a very small part, good shape was obtained overall. As a result of cutting 1 thick part, there were no shrink cavities (FIG. 10). The microstructure of the cut surface B is shown in FIG. 11. The number of graphite particles was about 13 times that of sand type mass-produced products. The chill generation was not observed. By temperature measurement during casting, it was confirmed that it was filled up just above the eutectic temperature.

Figure 12:
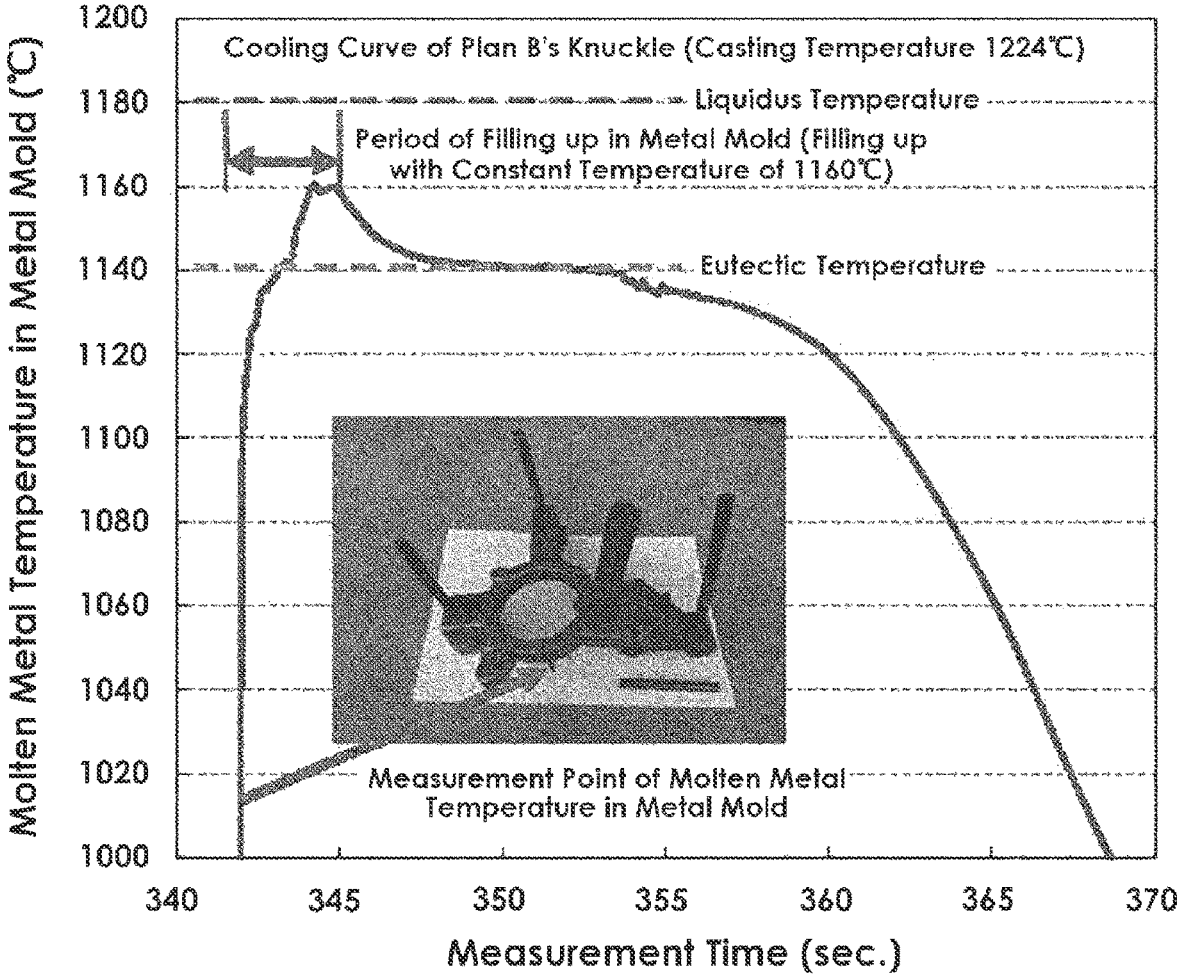
FIG. 12 shows a graph indicating a relationship between a molten metal temperature in a metal mold and a filling behavior.
Figure 13:
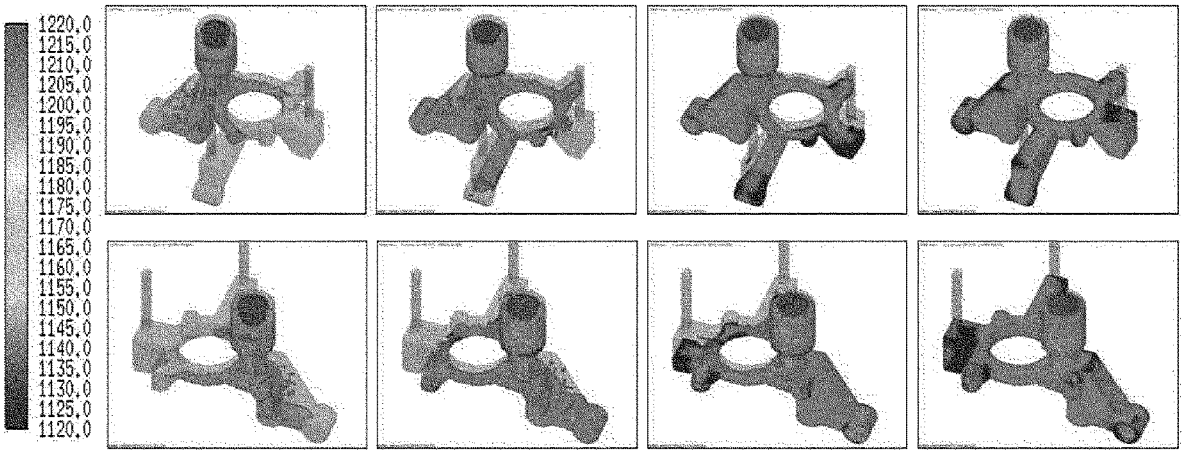
FIG. 13 shows a molten flow analysis model view indicating a relationship between a molten metal temperature in a metal mold and a filling behavior

FIG. 12 and FIG. 13 show a relationship between the melt temperature measurement in the metal mold and the filling up behavior during casting. It was found that the temperature of the measurement portion during filling in the metal mold was almost constant at 1160° C., and the filling up was carried out. This is because that the 1224° C. molten metal charged from the pouring gate was cooled in a runner (in a molten metal passageway) is filled up at the constant temperature at 1160° C. in the solid-liquid coexistence temperature region at the temperature measuring portion in the vicinity of the gate (product space entrance). It was confirmed that the flow behavior of the sleeve method, which the authors have done so far by semi-solid die casting of aluminum, is the same. As shown in FIG. 12, a cooling rate from a pouring temperature to a liquidus line passing temperature was (1224° C.-1180° C.)/2 sec.=22° C./sec. It is preferable to set the cooling rate at 20° C./s or more in view of refinement of spherical graphite.

Comparison of metal tissue and graphite particle number of each company sand mold mass-produced commercial knuckle and semi-solid cast product knuckle was examined. As a result, the number of graphite particles of the sand mold mass-produced commercial knuckle was 122 particles/mm$^2$ in Conventional Example A, 159 particles/mm$^2$ of Conventional Example B, and 171 particles/mm$^2$ in Conventional Example C. On the other hand, the number of graphite particles of the metal mold and semi-solid cast product knuckle was 1785 particles/mm$^2$ without pressurization and 2992 particles/mm$^2$ with pressurization. Compared with the sand type knuckle, the number of graphite grains was greatly large, and graphite refinement of ductile cast iron could be achieved.

With the development of a technique to semi-solidify the free nitrogen controlled molten metal in the metal mold, the knuckle made of ductile cast iron without chill and shrinkage cavities was obtained without heat treatment.

Figure 14:
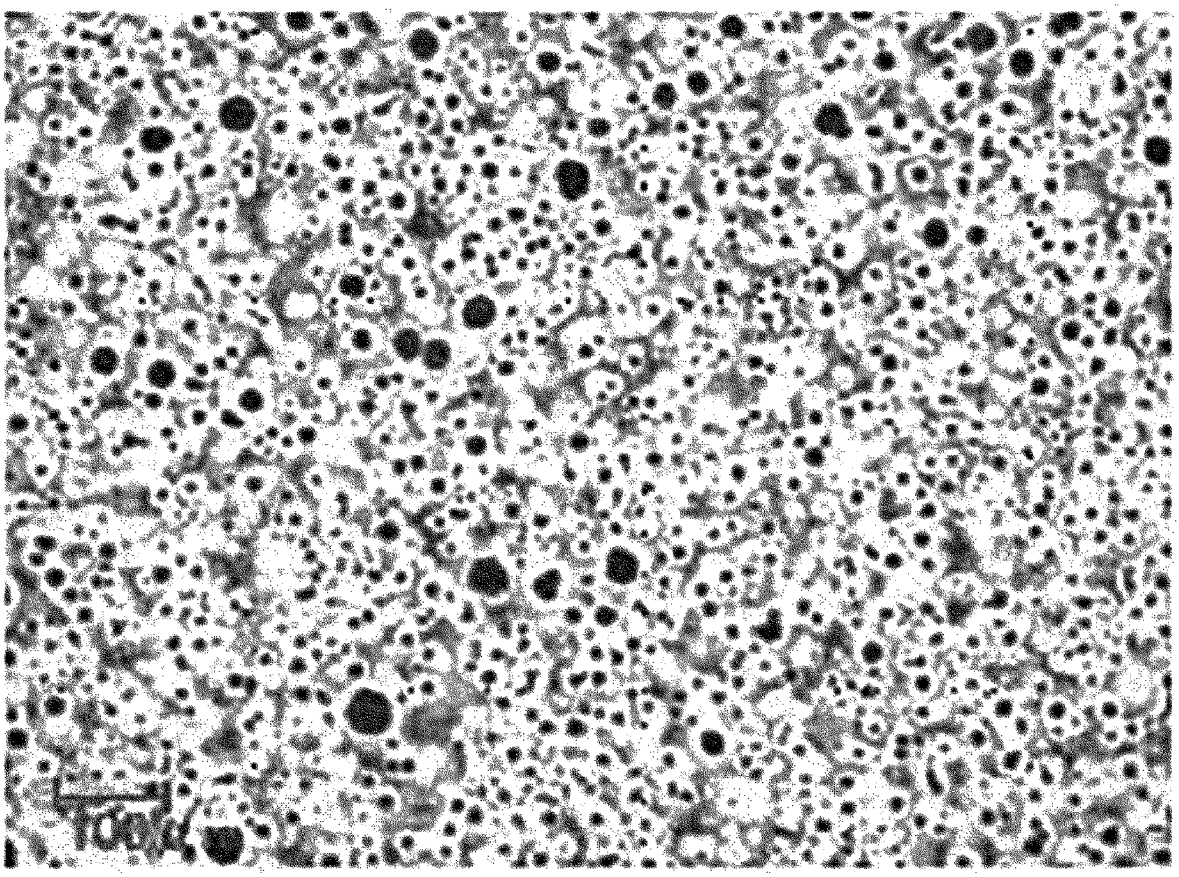
FIG. 14 shows a photograph indicating a metal tissue according to an embodiment. Pressurization is not carried out.
Figure 15:
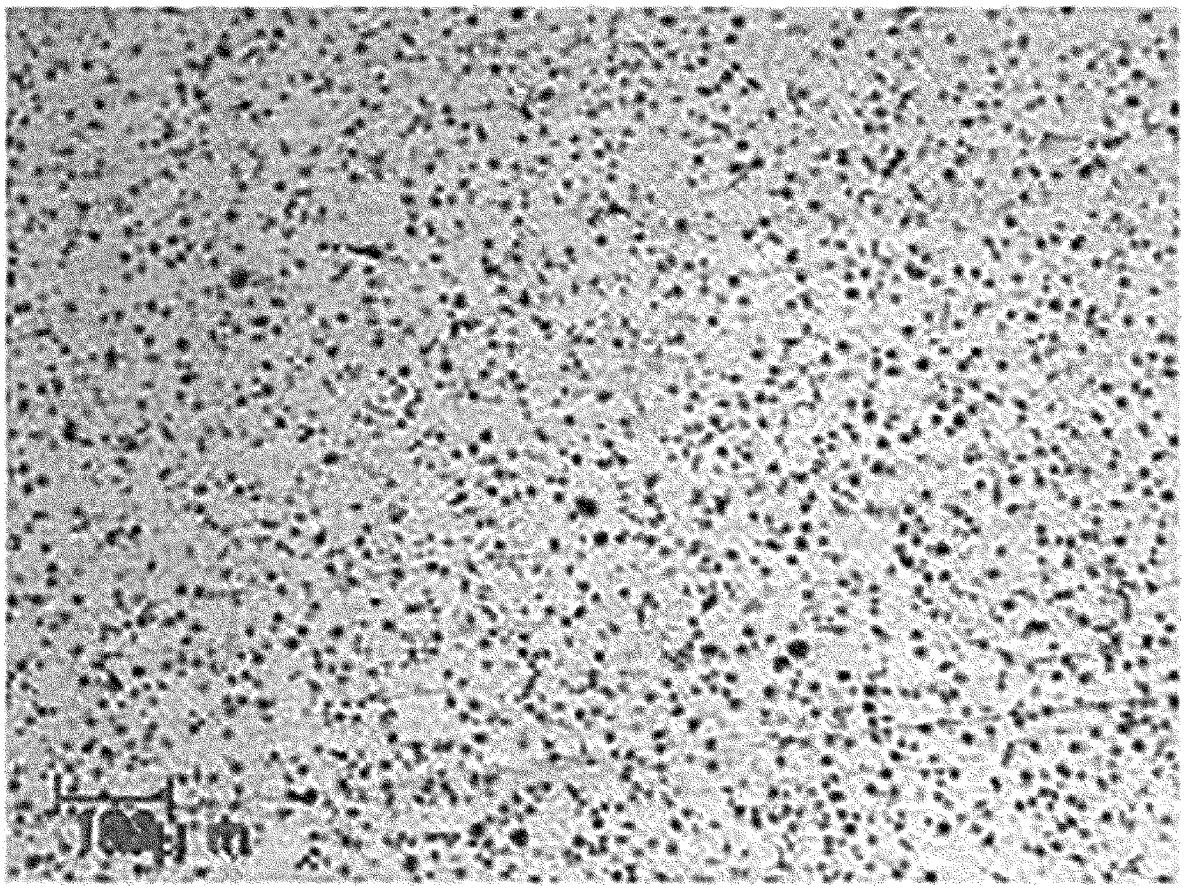
FIG. 15 shows a photograph indicating a metal tissue according to an embodiment. Pressurization is carried out.

The number of graphite particles of the knuckle of commercially available sand mold is 122 to 171 particles/$mm^2$. On the other hand, about the knuckle produced by the metal mold and the semi-solid cast, the number of graphite particles is 1785 particles/$mm^2$ (FIG. 14) without pressurization, and 2992 particles/$mm^2$ (FIG. 15) with pressurization. And then, refinement of semi-solidification molding was confirmed. Chill was not found at all. Particularly, in the case of FIG. 15, in which pressurization is carried out after filling up, spherical graphite having a particle size of 7 to 10 μm is distributed at 90% (number ratio) or more. In addition, even with large spherical graphite, the particle diameter was 20 μm or less. The knuckle was a part having a relatively large capacity and had a similar tissue in every part.

Example 2

In this example, a thickness of a coating film to be applied to the inner surface of the gate portion was thicker than that of Example 1.

However, the other points were the same as in Example 1.

In this example, the cooling rate of the molten metal was slower than 18° C./sec. in Example 1. In this example, the particle diameter of the spherical graphite was larger than that in Example 1.

Examples of gravity casting are shown in both Examples 1 and 2, and similar results are obtained in die casting.

Example 3

In this example, the pouring temperature was varied. The pouring temperature was varied within the range of (melting point+10° C.) to (melting point+80° C.).

The other points were the same as in Example 1.

In the case of (Melting point+80° C.), almost the same results as in Example 1 are obtained.

In the case of (Melting point+50° C.) or less, a fine and large amount of spherical graphite can be obtained as compared with the reference examples.

Also, in the case of (Melting point+10° C.), the fluidity was maintained, and finer and larger amount of spherical graphite was obtained than in Example 1. Conventionally, at low temperature, it is thought that it is necessary to introduce the product space to the product space at the molten state (temperature higher than the melting point) because of lack of fluidity. Therefore, it was in a molten state when passing through the gate. However, in the semi-solidified state, the inventors of the present invention have found that the fluidity is better than the molten metal state.

In addition, when the pouring temperature is low, excessive cooling is likely to occur, and a large amount of graphite nuclei are generated. When a semi-solidified raw material having a large amount of graphite nuclei is introduced into the product space, crystals grow on the basis of a large amount of graphite nuclei, and then a fine particle diameter can be obtained. On the other hand, when raw material is introduced into the product space in the state of molten metal, solidification starts from a portion in contact with the mold prior to generation of graphite nucleus in the interior, so fine crystals cannot be obtained. Also, if local cooling occurs, fluidity will be impaired because pressure loss will be applied to the following molten metal. The pouring temperature is preferably low.

However, in the case of less than (melting point+10° C.), it may solidify in a runner or the like before semi-solidification, so the pouring temperature is more preferably (melting point+10° C.) or more.

INDUSTRIAL APPLICABILITY

The present invention can also be applied to automobile parts such as knuckles and the like, which are required to have high toughness and strength, and electric and electronic parts.

What is claimed is:

1. A semi-solidification casting method for casting a spheroidal graphite cast iron cast product, comprising;

a melting step in which a raw material made of cast iron is heated and melted to obtain a molten metal, a spheroidizing treatment step of spheroidizing the molten metal, an inoculation step of inoculating the molten metal, and a casting step of pouring the molten metal after inoculation from a pouring port, passing through a runner, and filling a product space through a gate, wherein the amount of nitrogen in the molten metal is adjusted so that the amount of nitrogen generated during melting of the casting is 0.9 mass ppm or less, the pouring being performed at a temperature between liquidus temperature +10° C. and (liquidus line temperature +40° C.), and the molten metal poured from the pouring port is cooled in the runner and introduced into the product space through the gate in a solid-liquid coexistence state.

2. The semi-solidification casting method according to claim 1, wherein the cooling rate of the molten metal from the pouring temperature to the liquidus temperature after the pouring is 20° C./sec or more.

3. The semi-solidification casting method according to claim 1, wherein the solid-liquid coexistence state is at a temperature of 1140 to 1170° C.

4. The semi-solidification casting method according to claim 1, wherein after the filling, pressurization is performed.

5. The semi-solidification casting method according to claim 1, comprising, a step of heating a raw material to obtain a molten metal, a step of heating the molten metal at a certain temperature more than 1500° C., a step of stopping the heating and maintaining the temperature for a certain period of time in order to remove oxygen from the molten metal, a step of cooling the molten metal in order to reduce nitrogen in the molten metal, a step of spheroidizing treatment, a step of inoculation, and a step of casting.

* * * * *